US006045402A

United States Patent [19]

Embo et al.

[11] Patent Number: 6,045,402

[45] Date of Patent: Apr. 4, 2000

[54] HIGH-FREQUENCY COAXIAL ANGLED CONNECTOR ELEMENT

[75] Inventors: Georges Embo, Langemark; Edgard Acke, Oostkamp; Reginald Leeman, Oostende, all of Belgium

[73] Assignee: Siemens Aktiengesellschaft, Munich, Germany

[21] Appl. No.: 09/205,442

[22] Filed: Dec. 4, 1998

[30] Foreign Application Priority Data

Dec. 4, 1997 [DE] Germany ..... 197 53 839

[51] Int. Cl.[7] ..... H01R 9/05

[52] U.S. Cl. ..... 439/579; 439/573; 439/578; 439/63; 439/561

[58] Field of Search ..... 439/579, 580, 439/581, 770, 573, 578, 910, 912, 567, 571, 679, 680, 63, 701, 675, 540.1

[56] References Cited

U.S. PATENT DOCUMENTS

| | | | |
|---|---|---|---|
| 4,741,703 | 5/1988 | Johnescu et al. | 439/63 |
| 5,215,470 | 6/1993 | Henry et al. | 439/63 |
| 5,334,050 | 8/1994 | Andrews | 439/579 |
| 5,348,491 | 9/1994 | Louwagie et al. | 439/188 |
| 5,401,187 | 3/1995 | Ortega | 439/567 |
| 5,613,880 | 3/1997 | Wang . | |
| 5,624,278 | 4/1997 | Kuroda et al. | 439/675 |
| 5,879,166 | 3/1999 | Wang | 439/63 |

FOREIGN PATENT DOCUMENTS

| | | |
|---|---|---|
| 0555933B1 | 8/1993 | European Pat. Off. . |
| 19716139C1 | 6/1998 | Germany . |
| 97/40554 | 10/1997 | WIPO . |

*Primary Examiner*—Gary F. Paumen
*Assistant Examiner*—Truc Nguyen
*Attorney, Agent, or Firm*—Herbert L. Lerner; Laurence A. Greenberg; Werner H. Stemer

[57] ABSTRACT

A high-frequency coaxial right-angle connector element has coaxial connecting lines disposed in a housing. The housing is formed from metallized plastic and is provided with many contact bases peripherally on its underside. The contact bases serve to fasten the housing onto or on a board and to connect the coaxial connecting lines with associated terminals on the board. The coaxial connecting lines are inserted into straight tubular leadthroughs in the housing, formed in a plane parallel to the underside of the housing. The leadthroughs have groovelike recesses on the rear of the housing, in which the rear end pieces of the internal conductors extend downwardly out of the housing.

17 Claims, 3 Drawing Sheets

HIGH-FREQUENCY COAXIAL ANGLED CONNECTOR ELEMENT

BACKGROUND OF THE INVENTION

1. Field of the Invention

The invention relates to a high-frequency coaxial angle or right-angle connector element, comprising coaxial connecting lines, disposed in a housing, with coaxial plug elements—coaxial plug element module—protruding from the front of the housing. The module is secured to a board, such as a printed circuit board, in which the housing of the coaxial plug element module comprises metallized plastic and on the periphery of its underside has many contact bases with support faces acting as SMD terminals. The faces serve the purpose both of securing the housing on or to the board and of connecting the coaxial connecting lines with the terminals associated with the board.

HF coaxial right-angle connectors of that kind have become known from the earlier German patent application 197 16 139.1 and commonly assigned co-pending application No. 09/176,816 (German application DE 197 46 637.0). Compared with prior art monoblocks, of the kind known for instance from European patent specification EP 0 555 933 B1, the design of these coaxial plug element modules has the advantage of a substantially less expensive design from a production standpoint and a lower overall weight.

In the coaxial right-angle connectors, the course of the coaxial connecting lines inside the housing must proceed at a right angle. Even in multicontact coaxial right-angle connectors, this presents no difficulties from the standpoint of the external conductors, and moreover requires no special provisions, because the external conductors of the coaxial connecting lines can be realized inside the housing by suitably designed, metallized inner housing walls. Mounting the internal conductors that are bent at an angle and are retained in insulation sleeves inside the external conductors, however, is not so simple and requires special, relatively complicated structural provisions. For mounting, either the internal conductors must be subdivided into two straight conductor segments to be joined together later, or relatively large mounting openings that can be closed later have to be provided in the back wall of the housing.

SUMMARY OF THE INVENTION

It is accordingly an object of the invention to provide an angled connector of the above-described type, which overcomes the above-mentioned disadvantages of the heretofore-known devices and methods of this general type and which provides for a further, especially simple structural version that is extraordinarily favorable to fully automatic production.

With the foregoing and other objects in view there is provided, in accordance with the invention, a high-frequency coaxial right-angle connector element, comprising:

- a housing formed of metallized plastic, the housing having a front, a rear, and an underside with a periphery;
- coaxial connecting lines disposed in the housing, the coaxial connecting lines each including a coaxial plug element protruding from the front of the housing;
- a plurality of contact bases with support faces defining SMD terminals on the periphery of the underside of the housing, the support faces being adapted to secure the housing to a conductor board and to connect the coaxial connecting lines to conductors of the conductor board;

- the coaxial connecting lines including intrinsically straight external conductor sleeves and internal conductors inserted in the external conductor sleeves, the internal conductors having a forward end piece, a rear end piece, and an insulation sheath between the forward end piece and the rear end piece;
- the housing having straight tubular leadthroughs formed therein extending from the rear to the front of the housing, the tubular leadthroughs being disposed side by side in a plane parallel to the underside of the housing at predetermined mutual spacings;
- the coaxial connecting lines being inserted from the rear of the housing into the tubular leadthroughs and retained therein in a press fit, and the coaxial plug elements protruding out of the front;
- the tubular leadthroughs on the rear of the housing being formed with groovelike recesses opening toward the rear and the underside of the housing; and
- the rear end pieces of the internal conductors defining terminal ends extending downward out of the housing in the groovelike recesses.

In accordance with an added feature of the invention, the housing and the coaxial connecting line together form a coaxial plug element module to be secured and connected to a printed circuit board.

In other words, the objects of the invention are satisfied in that the coaxial connecting lines, which on their front end have the coaxial plug elements, have intrinsically straight external conductor sleeves, into which the internal conductors, which are sheathed with an insulation and have a front and a rear end piece free of insulation, are inserted. The housing, for receiving the coaxial connecting lines, is provided with straight tubular leadthroughs from its back side to its front side. The leadthroughs are side by side in a plane parallel to its underside at predetermined mutual spacings. The coaxial connecting lines are inserted from the rear of the housing into the tubular leadthroughs far enough, and are retained in a press fit, that they protrude with their coaxial plug elements out of the front side. The tubular leadthroughs on the back side of the housing have groovelike recesses open toward its back side and its underside. The rear end pieces of the internal conductors of the coaxial connecting lines act as terminal ends that are extended downward out of the housing in the groovelike recesses.

In accordance with an additional feature of the invention, a length of the external conductor sleeves of the coaxial connecting lines is shorter than a length of the coaxial plug elements, protruding from the front of the housing, plus a length of the tubular leadthroughs of the housing; and the coaxial connecting lines, toward the external conductors, extend past the rear end of the external conductor sleeves through metallized inner walls of the tubular leadthroughs to the rear of the housing.

In accordance with another feature of the invention:

- the contact bases are short support attachments on an outer wall at the rear and on the sidewalls of the housing that extend between the rear and front sides;
- the support faces of the contact bases defining the SMD terminals are oriented parallel to the underside of the housing and protrude slightly past the underside; and
- the rear end pieces of the internal conductors of the coaxial connecting lines include solder bases bent outward at an angle to the contact bases, the solder bases being coplanar with the support faces of the contact bases.

In accordance with a further feature of the invention, the housing has at least one insertion hole formed in a top wall thereof and between the tubular leadthroughs, for an additional fastening of the housing to the conductor board.

In accordance with again an added feature of the invention, an annular flange base frames the at least one insertion hole at the underside. The annular flange base has a support face that is coplanar with the support faces of the contact bases.

In accordance with again an additional feature of the invention, a plurality of bases are disposed along a line on the underside of the housing and in the vicinity of the front side. The bases have support faces that are coplanar with the support faces of the contact bases.

In accordance with again a further feature of the invention, the coaxial connecting lines are formed with a stop defined by an abrupt change in an outer diameter thereof, and the tubular leadthroughs in the housing are each formed with a counterpart stop defined by an abrupt change in an inner diameter thereof.

In accordance with yet an added feature of the invention, the stop of the coaxial lines is a diameter step on the external conductor sleeves.

In accordance with yet an additional feature of the invention, the internal conductors of the coaxial connecting lines, upon being inserted into the external conductor sleeves from a rear end thereof run up simultaneously against two stops. A first one of the two stops is an abrupt change in an inner diameter in the region of the front end of the external conductor sleeves of the coaxial connecting lines for the front end face of the insulation surrounding the internal conductors, and a second one of the two stops is an abrupt change in an outer diameter of the insulation, surrounding the internal conductors, for the rear end face of the external conductor sleeves.

In accordance with yet another feature of the invention, centering means are provided on the underside of the housing for centering the housing on or to the conductor board, the centering means being associated with centering means on the conductor board. Preferably, the centering means on the underside of the housing are centering pins on the underside of the housing and the centering means on the conductor board are corresponding holes formed in the conductor board.

In accordance with an added feature of the invention:

the internal conductors each are formed with at least one short widened portion in a region between the forward end piece and the rear end piece; and the insulation sheath is formed with a window opening during a spray-coating of the internal conductors allowing access to the widened portion for wave impedance calibration.

In accordance with an additional feature of the invention, the coaxial connecting lines are formed with a lateral cam on the rear ends for securing the connecting lines against relative rotation in the tubular leadthroughs of the housing, and the housing is formed with a meshing recess in which the cam engages upon being inserted into the tubular leadthroughs.

There is also provided a method of producing the connector element described above. The method comprises the following steps:

preparing the internal conductors of the coaxial connecting lines as parts of a stamped metal endless carrier belt facilitating fully-automatic assembly;

guiding the endless carrier belt peripherally along positioning holes formed in the endless carrier belt;

spray-coating the internal conductors between the rear end piece and the forward end piece with the insulation sheath;

forming the insulation-free rear and forward end pieces in a predetermined way; and subsequently cutting out individual internal conductors from the endless carrier belt for further mounting.

In accordance with yet again a further feature of the invention, the forward end piece of the internal conductors succeeding one another in the stamped endless carrier belt is a forked head structure, and the method further comprises forming the coaxial plug elements of the coaxial connecting lines into coaxial bush plug elements by rounding the crosspiece of the socket contact and shaping the tines thereof.

These process steps are particularly significant for fully automated production of the internal conductors, surrounded with an insulation, of the coaxial connecting lines.

In accordance with a concomitant feature of the invention, the coaxial plug elements of the coaxial connecting lines are coaxial bush plug elements with socket contacts, and the forward end pieces of the internal conductors are formed by reshaping a stamped endless carrier belt.

Other features which are considered as characteristic for the invention are set forth in the appended claims.

Although the invention is illustrated and described herein as embodied in a high-frequency coaxial right-angle connector element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
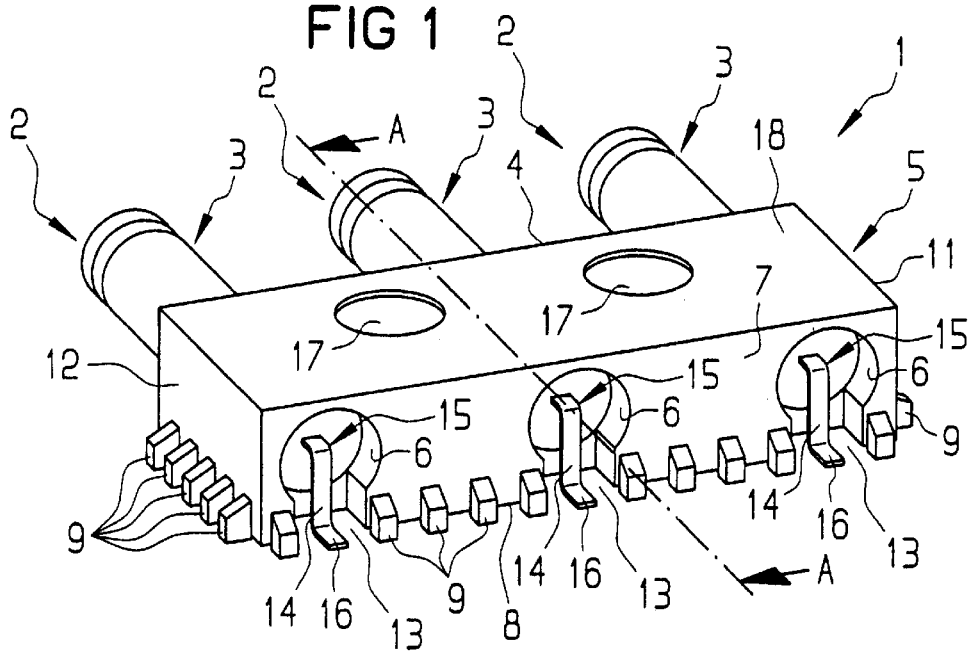
FIG. 1 is a top, rear perspective view of an exemplary embodiment of a coaxial plug element module.

Referring now to the figures of the drawing in detail and first, particularly, to FIG. 1 thereof, there is seen an exemplary embodiment of a coaxial plug element module 1 with three coaxial connecting lines 2, whose coaxial plug elements 3 protrude out of a front side 4 of its housing 5. The housing 5 is formed of metallized plastic. The layer thickness of the metallization of the housing 5 is selected to be at least equal to a penetration depth of the electromagnetic waves to be transmitted via the coaxial plug element module 1. The housing 5 has three straight tubular leadthroughs 6 from its back side 7 to its front side 4 for receiving the three coaxial connecting lines 2. As FIG. 1 shows, the coaxial connecting lines 2 are disposed side by side at predetermined mutual spacings in the leadthroughs 6, in a plane parallel to the underside 8 of the housing 5. The housing 5 is shown again, with a view to its underside 8, in FIG. 3, which will be described below.

The coaxial plug element module 1 has many contact bases 9 with support faces 10 acting as SMD terminals, which are disposed in a comblike structure on the outer wall of the back side 7 and the sides 11 and 12 of the housing that join the back side 7 and the front side 4 to one another. The contact bases 9, with their support faces 10 parallel to the underside and embodied as tin-plated SMD terminals, protrude slightly past the underside 8. The contact bases 9 serve both to secure the housing on or to a board, in particular a printed circuit board, and to electrically connect their SMD terminals to these terminals disposed on the board. To assure perfect soldered connections when the coaxial plug element module 1 is joined to an underlay for the SMD terminals, it is necessary to provide a planarity tolerance of $\leqq 0.1$ mm between all the support faces 10 of the contact bases 9.

The tubular leadthroughs 6 have groovelike recesses 13 on the back side of the housing 5, which are open toward the back side 7 and the underside 8. The rear end pieces 14 of the internal conductors 15 of the coaxial connecting lines 2, which pieces act as terminals, are extended downward out of the housing 5 in these recesses 13. On their free ends, the rear end pieces 14 of the internal conductors 15 have angled soldered bases 16, which are oriented in coplanar fashion with the support faces 10 of the contact bases 9.

Figure 3:
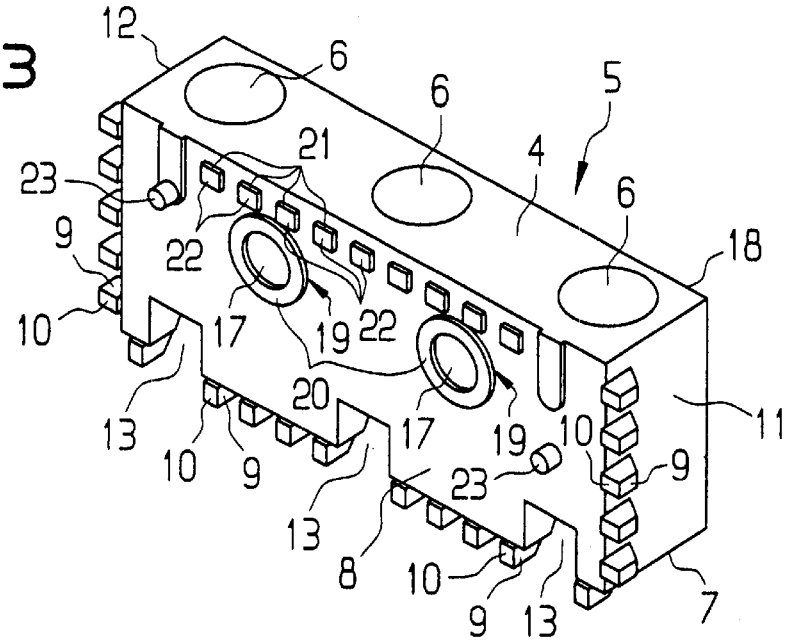
FIG. 3 is a bottom perspective view of the housing of the coaxial plug element module of FIG. 1.

The housing 5 may be additionally fastened to a board by means of screws or rivets. For that purpose, the housing is provided with insertion holes 17 on its top 18, in the region between the tubular leadthroughs 6. With reference to FIG. 3, the insertion holes 17 have an annular flangelike base 19 on the underside 8 of the housing 5, the support face 20 of which base is coplanar with the support faces 10 of the contact bases 9. Another row of bases 21 is provided on the underside 8 of the housing 5, toward its front side 4 on which no contact bases 9 are provided. The support faces 22 of the bases 21 are also coplanar with the support faces 10 of the contact bases 9. The housing 5 is also provided on its underside 8 with centering pins 23, with which centering bores are associated on a non-illustrated board, on which the coaxial plug element module 1 is to be secured.

Figure 2:
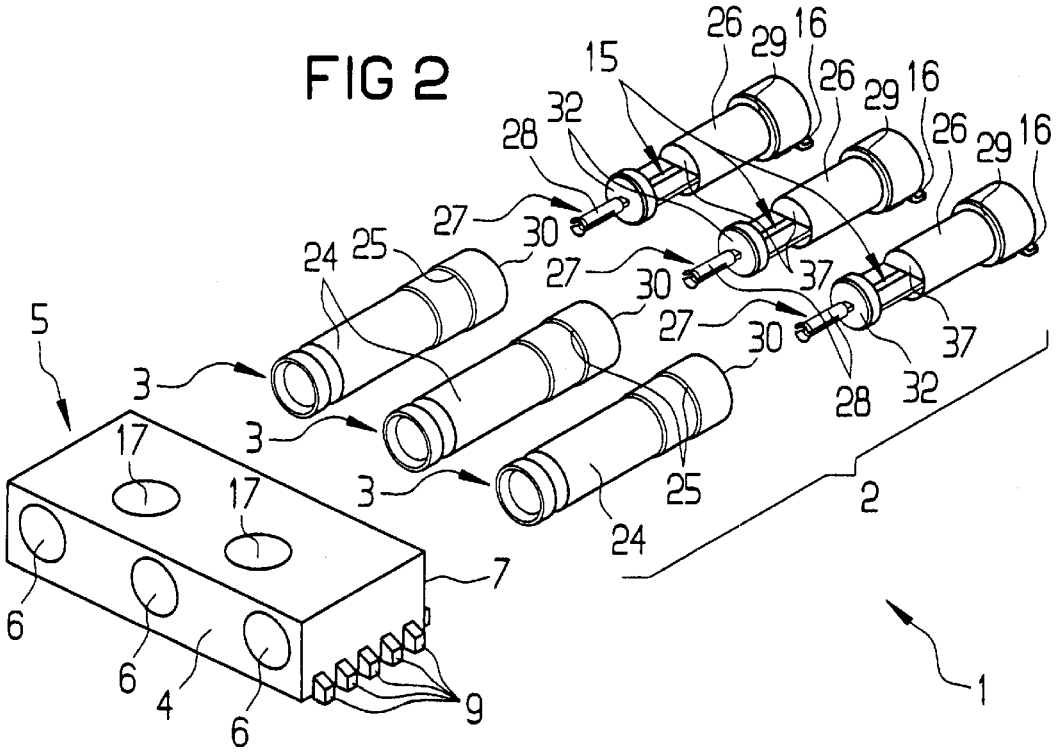
FIG. 2 is an exploded, front top perspective view of the coaxial plug element module of FIG. 1.

The exploded view of the coaxial plug element module 1 in FIG. 2 illustrates the assembly of its individual parts. The coaxial connecting lines 2 with their coaxial plug elements 3 on the front end have external conductor sleeves 24, which in the rear region have a stop 25 in the form of an abrupt change in outer diameter. The external conductor sleeves 24 may comprise metallized plastic, or if higher quality is demanded of the coaxial plug elements 3 of the coaxial connecting lines 2, they may be metal sleeves. The internal conductors 15, spray-coated with an insulation 26, are inserted into the external conductor sleeves 24 from behind. The forward insulation-free end pieces 27 are shaped as socket contacts 28. The tubular insulation 26 also has a stop 29 in its rear region for the rear face end 30 of the external conductor sleeves 24, in the form of an abrupt change, i.e. a step in its outer diameter.

Figure 4:
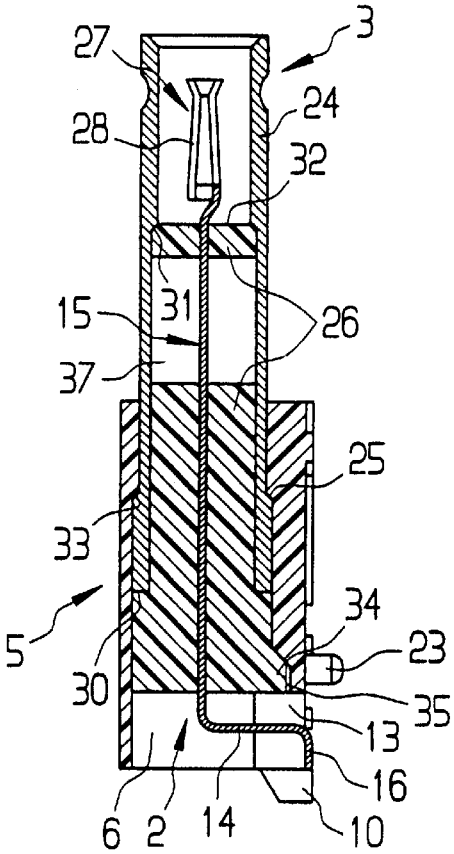
FIG. 4 is a sectional view taken along the line A—A through the coaxial plug element module of FIG. 1.

Referring now to FIG. 4, which illustrates a section along the line A—A in FIG. 1, the external conductor sleeves 24 also have a stop 31 in their forward region for the front face end 32 of the insulation 26. The stop 31 is defined by an abrupt change in its inner diameter. The tubular leadthroughs 6 also have a counterpart stop 33 for the coaxial connecting lines 2 receiving them. In order for the coaxial connecting lines 2, thrust from behind until they come to a stop into the leadthroughs 6 of the housing 5, to be positioned in a manner secure against relative rotation in the leadthroughs 6, the insulation 26 surrounding the internal conductors 15 has a cam 34, toward the rear end piece 14 of the internal conductors 15, which engages an associated recess 35 in the housing wall.

As FIG. 4 also shows clearly, the length of the external conductor sleeves 24 of the coaxial connecting lines 2 is selected to be shorter than the length of their coaxial plug elements 3 protruding out of the housing 5 and the length of the tubular leadthroughs 6. In other words, toward the outer conductor, the coaxial connecting lines 2 are lengthened beyond the rear face end 30 of their external conductor sleeves 24 by the metallized inner walls of the tubular leadthroughs 6 as far as the back wall 7 of the housing 5. In this way, the total weight of the coaxial plug element module 1 is kept as slight as possible, even if metal external conductor sleeves 24 are used.

The production of the internal conductors 15, spray-coated with insulating material 26 between their end pieces 14 and 27, proves to be especially economical if the internal conductors are stamped sheet-metal parts. In that case, the socket contact 28 acting as the forward end piece 27 of the internal conductor 15 can also, as can be seen from the internal conductor 15 shown on a larger scale in FIG. 5, be realized in a simple way by means of bent-over sheet-metal strips. As FIG. 5 also shows, the internal conductor 15 has a widened portion 36 below its forward end piece 27. This portion 36 serves the purpose of wave impedance adaptation of the coaxial connecting lines should that become necessary. For this reason, the insulation 26 sheathing the internal conductor 15 is provided with a window opening 37 in this widened portion 36. The widened portion 38 above the rear end piece 14 of the internal conductors 15 also serves the purpose of wave impedance adaptation and takes into account the insulation 26 that sheaths the internal conductor 15 and is widened in diameter in this portion 38.

Figure 5:
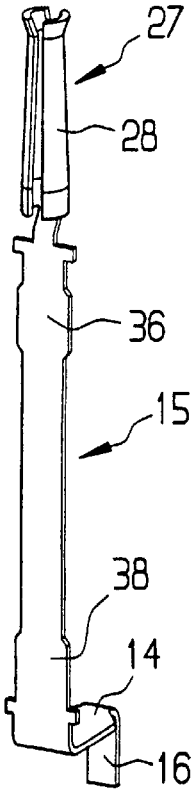
FIG. 5 is a perspective view of an internal conductor of a coaxial connecting line.
Figure 6:
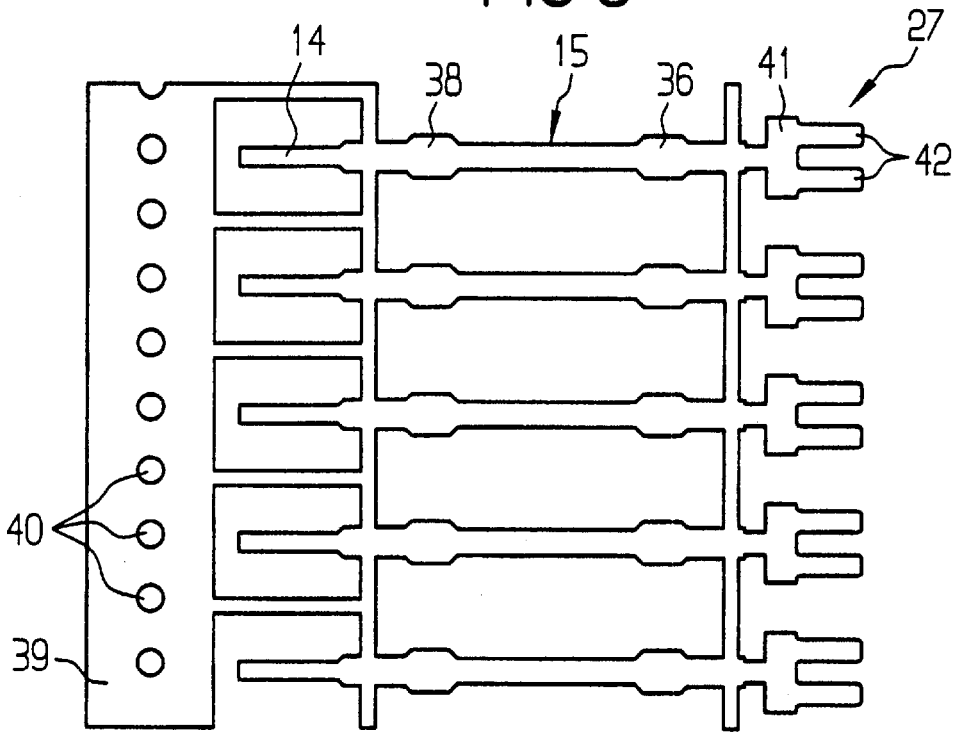
FIG. 6 is a partial plan view onto a stamped endless carrier belt for internal conductors.
Figure 7:
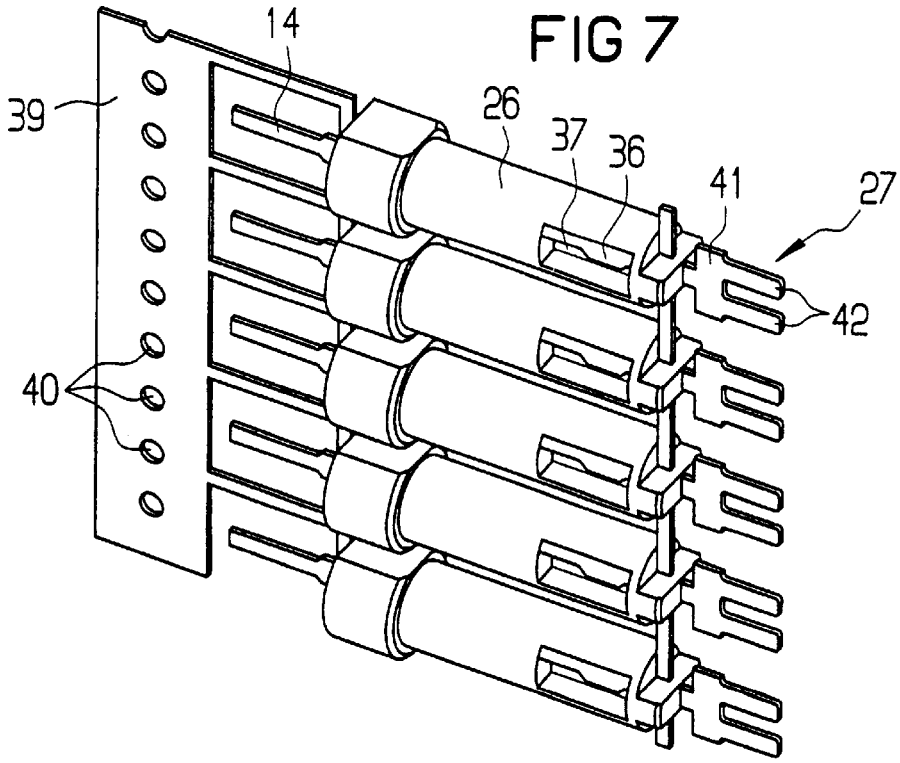
FIG. 7 is a perspective view of the stamped part of the endless carrier belt of FIG. 6 with internal conductors spray-coated with an insulation between their end pieces.

Reference will now be had to FIGS. 6 and 7: Fully automatic assembly of the coaxial plug element modules is especially possible where the internal conductors 15 are parts of a stamped metal endless carrier belt 39. By means of the endless carrier belt 39 guided peripherally in positioning holes 40, the internal conductors 15 are spray-coated with an insulation 26, progressively at first, between their end pieces 14 and 27, as FIG. 7 shows. After that, the end pieces 14 and 27 are shaped in a predetermined way, and then the internal conductors 15 sheathed with the insulation 26 are cut out from the endless carrier belt 39. To make socket contacts 28, the forward end pieces 27 of the internal conductors 15 are shaped like forked heads. By rounding the crosspiece 41 of the fork and shaping its tines 42, these end pieces 27 are reshaped into a socket contact 28, as shown in FIG. 5.

The term "right-angle connector" is a term of art used herein to denote any angled connector wherein the coaxial cable connection is not axially aligned with the connection on the conductor board. The term "right-angle" does not limit the structure to 90°.

We claim:

1. A high-frequency coaxial right-angle connector element, comprising:

a housing formed of metallized plastic, said housing having a front, a rear, and an underside with a periphery;

coaxial connecting lines disposed in said housing, said coaxial connecting lines each including a coaxial plug element protruding from said front of said housing;

a plurality of contact bases with support faces defining SMD terminals on said periphery of said underside of said housing, said support faces being adapted to secure said housing to a conductor board and to connect said coaxial connecting lines to conductors of the conductor board;

said coaxial connecting lines including intrinsically straight external conductor sleeves and internal conductors inserted in said external conductor sleeves, said internal conductors having a forward end piece, a rear end piece, and an insulation sheath between said forward end piece and said rear end piece;

said housing having straight tubular leadthroughs formed therein extending from said rear to said front of said housing, said tubular leadthroughs being disposed side by side in a plane parallel to said underside of said housing at predetermined mutual spacings;

said coaxial connecting lines being inserted from said rear of said housing into said tubular leadthroughs and retained therein in a press fit, and said coaxial plug elements protruding out of said front;

said tubular leadthroughs on said rear of said housing being formed with groovelike recesses opening toward said rear and said underside of said housing; and said rear end pieces of said internal conductors defining terminal ends extending downward out of said housing in said groovelike recesses.

2. The connector element according to claim 1, wherein said housing and said coaxial connecting line together form a coaxial plug element module to be secured and connected to a printed circuit board.

3. The connector element according to claim 1, wherein:

a length of said external conductor sleeves of said coaxial connecting lines is shorter than a length of said coaxial plug elements, protruding from said front of said housing, plus a length of said tubular leadthroughs of said housing; and said coaxial connecting lines, toward said external conductors, extend past said rear end of said external conductor sleeves through metallized inner walls of said tubular leadthroughs to said rear of said housing.

4. The connector element according to claim 1, wherein:

said housing includes sidewalls joining said rear and said front to one another, and said contact bases are short support attachments on an outer wall at said rear and on said sidewalls of said housing;

said support faces of said contact bases defining said SMD terminals are oriented parallel to said underside of said housing and protrude slightly past said underside; and said rear end pieces of said internal conductors of said coaxial connecting lines include solder bases bent outward at an angle to said contact bases, said solder bases being coplanar with said support faces of said contact bases.

5. The connector element according to claim 1, wherein said housing has at least one insertion hole formed in a top wall thereof and between said tubular leadthroughs, for an additional fastening of said housing to the conductor board.

6. The connector element according to claim 5, which further comprises an annular flange base framing said at least one insertion hole at said underside, said annular flange base having a support face coplanar with said support faces of said contact bases.

7. The connector element according to claim 1, which further comprises a plurality of bases disposed along a line on said underside of said housing and in vicinity of said front side, said bases having support faces coplanar with said support faces of said contact bases.

8. The connector element according to claim 1, wherein said coaxial connecting lines are formed with a stop defined by an abrupt change in an outer diameter thereof, and said tubular leadthroughs in said housing are each formed with a counterpart stop defined by an abrupt change in an inner diameter thereof.

9. The connector element according to claim 8, wherein said stop of said coaxial lines is a diameter step on said external conductor sleeves.

10. The connector element according to claim 1, wherein said internal conductors of said coaxial connecting lines, upon being inserted into said external conductor sleeves from a rear end thereof run up simultaneously against two stops, a first one of said two stops being an abrupt change in an inner diameter in the region of the front end of said external conductor sleeves of said coaxial connecting lines for said front end face of said insulation surrounding said internal conductors, and a second one of said two stops being an abrupt change in an outer diameter of said insulation, surrounding said internal conductors, for said rear end face of said external conductor sleeves.

11. The connector element according to claim 1, which further comprises centering means on said underside of said housing for centering said housing on or to the conductor board, said centering means being associated with centering means on the conductor board.

12. The connector element according to claim 11, wherein said centering means on said underside of said housing are centering pins on said underside of said housing and said centering means on the conductor board are corresponding holes formed in the conductor board.

13. The connector element according to claim 1, wherein:

said internal conductors each being formed with at least one short widened portion in a region between said forward end piece and said rear end piece; and said insulation sheath being formed with a window opening during a spray-coating of said internal conductors allowing access to said widened portion for wave impedance calibration.

14. The connector element according to claim 1, wherein said coaxial connecting lines are formed with a lateral cam on said rear ends for securing said connecting lines against relative rotation in said tubular leadthroughs of said housing, and said housing is formed with a meshing recess in which said cam engages upon being inserted into said tubular leadthroughs.

15. A method of producing the connector element according to claim 1, which comprises:

preparing the internal conductors of the coaxial connecting lines as parts of a stamped metal endless carrier belt facilitating fully-automatic assembly;

guiding the endless carrier belt peripherally along positioning holes formed in the endless carrier belt;

spray-coating the internal conductors between the rear end piece and the forward end piece with the insulation sheath;

forming the insulation-free rear and forward end pieces in a predetermined way; and subsequently cutting out individual internal conductors from the endless carrier belt for further mounting.

16. The method according to claim 15, wherein the forward end piece of the internal conductors succeeding one another in the stamped endless carrier belt is a forked head structure, and the method further comprises forming the coaxial plug elements of the coaxial connecting lines into coaxial bush plug elements by rounding the crosspiece of the socket contact and shaping the tines thereof.

17. The connector element according to claim 1, wherein said coaxial plug elements of said coaxial connecting lines are coaxial bush plug elements with socket contacts, and said forward end pieces of said internal conductors are formed by reshaping a stamped endless carrier belt.

* * * * *